US005316499A

United States Patent [19]

Scannelli et al.

[11] Patent Number: 5,316,499

[45] Date of Patent: May 31, 1994

[54] COAXIAL CONNECTOR WITH ROTATABLE MOUNTING FLANGE

[75] Inventors: Anthony R. Scannelli, Stoneham; Donald G. Gartzke, Ipswich; Christopher Lewis, Southboro, all of Mass.

[73] Assignee: Dynawave Incorporated, Georgetown, Mass.

[21] Appl. No.: 7,645

[22] Filed: Jan. 21, 1993

[51] Int. Cl.[5] ..... H01R 13/74

[52] U.S. Cl. ..... 439/534; 439/582

[58] Field of Search ..... 439/63, 581, 582, 534, 439/550, 563, 564, 569, 573, 578

[56] References Cited

U.S. PATENT DOCUMENTS 3,047,828 7/1962 Gregson et al. ..... 439/582

3,480,722 11/1969 Van Horssen et al. ..... 439/582

4,125,308 11/1978 Schilling ..... 439/63

5,026,302 6/1991 Spencer ..... 439/578

FOREIGN PATENT DOCUMENTS 920725 3/1963 United Kingdom ..... 439/582

*Primary Examiner*—Gary F. Paumen

*Attorney, Agent, or Firm*—John E. Toupal; Harold G. Jarcho

[57] ABSTRACT

A coaxial cable connector including an annular outer conductor; an inner conductor disposed coaxially within the outer conductor; an annular insulator retained between the inner conductor and the outer conductor; and an annular mounting flange rotatably mounted on the outer conductor and projecting radially outwardly therefrom.

19 Claims, 2 Drawing Sheets

COAXIAL CONNECTOR WITH ROTATABLE MOUNTING FLANGE

BACKGROUND OF THE INVENTION

This invention relates generally to an electrical connector assembly and, more particularly, to an electrical connector assembly for connecting coaxial radio frequency transmission lines.

Plug type connector assemblies are used commonly to facilitate quick connection and disconnection of components or modules in electrical circuit systems. Such connector assemblies permit rapid access to electrical components for maintanance or repair functions. Many connectors include flanges that attach to equipment housings and mounting problems can result from requirements for proper alignment of the flanges on the housings. Also, when used in certain applications such as for the transmission of rf signals, an important requirement of plug type connectors is that they exhibit a relatively low electrical signal disturbance characteristic in that signal interference or attenuation can significantly degrade the performance of an entire electrical system.

The object of this invention, therefore, is to provide for coaxial transmission lines an improved plug type connector assembly that combines a quick connect-disconnect capability with a low signal disturbance characteristic.

SUMMARY OF THE INVENTION

The invention is a coaxial cable connector including an annular outer conductor; an inner conductor disposed coaxially within the outer conductor; an annular insulator retained between the inner conductor and the outer conductor; and an annular mounting flange rotatably mounted on the outer conductor and projecting radially outwardly therefrom. During installation of the connector, the mounting flange can be rotated into a desired position.

According to one feature of the invention, the mounting flange is electrically conductive. The conductive mounting flange facilitates the creation of a ground circuit.

According to other features of the invention, the outer conductor has an inner cylindrical surface engaging the annular insulator and an outer cylindrical surface defining an annular recess, and the mounting flange has an inner portion rotatably received by the annular recess. The annular recess retains the mounting flange in position prior to installation.

According to other features of the invention, the outer conductor includes a hollow cylindrical inner body with a radially outwardly projecting shoulder portion defining one sidewall of the annular recess, and an annular outer body with an inner cylindrical surface engaging and soldered to the inner body and having an annular inner edge longitudinally spaced from the shoulder portion and defining another sidewall of the annular recess. The arrangement provides a unitary outer conductor assembly having the desired annular recess.

According to yet another feature of the invention, the connector includes an annular spacer rotatably received by the annular recess and disposed between the inner portion of the mounting flange and the another sidewall. The spacer restricts longitudinal movement of the mounting flange in the annular recess.

According to further features, the inner portion of the mounting flange includes an annular transverse wall portion projecting transversely to the inner conductor; the mounting flange includes an annular inner edge portion intersecting the transverse wall portion, projecting longitudinally thereto, and spaced from the outer cylindrical surface; the annular transverse wall portion, the annular inner edge portion and the outer cylindrical surface forming an inner annular groove; and the connector includes an annular electrically conductive gasket disposed in the inner annular groove. The conductive gasket reduces r.f. leakage.

According to an additional feature of the invention, the outer conductor defines a radially extending inner edge portion oriented substantially parallel to the mounting flange and axially spaced therefrom. The inner edge portion forms a mating surface for the outer conductor of a coaxial connector.

According to still further features of the invention, the inner conductor has inner and outer ends, the annular outer body defines a first opening axially aligned with the inner end and a second opening transversely aligned with the inner end; and the connector includes a cap covering the first opening. The second opening receives an end of a coaxial cable, the first opening provides access for soldering the cable to the inner conductor, and the cap isolates the soldered connection after completion.

According to yet another feature of the invention, the cylindrical inner body has an outer edge, the annular outer body extends axially from the outer edge so as to form therewith an annular outer groove, and the connector includes an electrically conductive ring disposed in the outer groove and engaged by the cap. The conductive ring further reduces r.f. leakage.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 2:
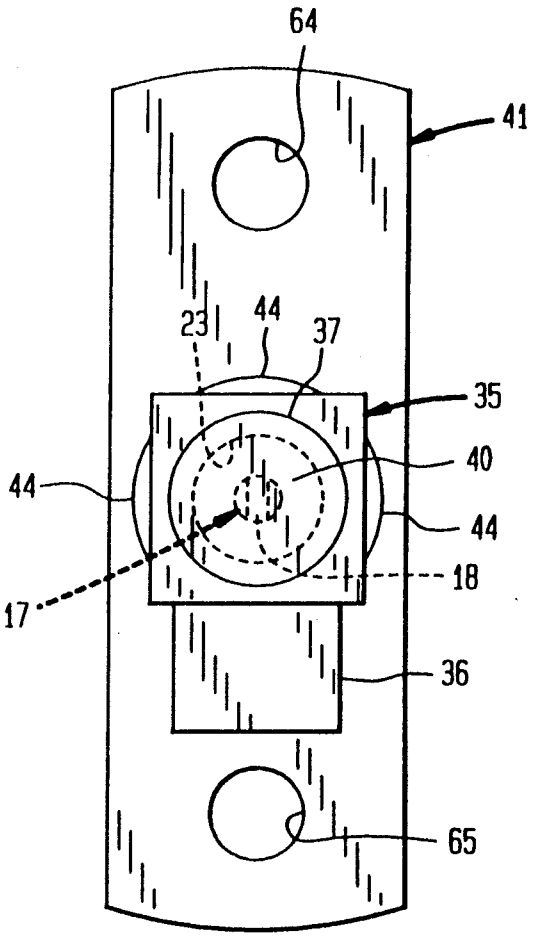
FIG. 2 is a left end view of the connector shown in FIG. 1.

A coaxial connector 11 includes an annular outer conductor 12, an inner conductor 13 coaxially disposed within the outer conductor 12 and an annular insulator 14 retained between the outer conductor 12 and the inner conductor 13. An inner end 16 of the inner conductor 13 defines a female socket and an outer end 17 thereof defines a transverse slot 18. During use of the connector 11, the inner end socket 16 and transverse slot 18 accommodate the inner conductors of coaxial cables.

Forming the outer conductor 12 as a unitary assembly are a hollow cylindrical inner body 21 and an annular outer body 22 soldered thereto. The inner body 21 has a cylindrical inner surface 23 engaging the annular insulator 14 and a cylindrical outer surface 24 interrupted by a radially outwardly projecting shoulder portion 25. Formed by the outer conductor 12 is an outwardly opening annular recess 28 having a bottom wall defined by the outer surface 24 of the inner body 21, one sidewall defined by the shoulder portion 25 and another sidewall defined by an inner edge 29 of the outer body 22. The outer body 22 has a cylindrical inner surface 31 that engages the outer surface 24 of the inner body 21 and extends axially outwardly from an outer edge 32 thereof so as to form therewith an outer groove 33. Formed by the outer body 22 is a head portion 35 of square cross section and defining the cylindrical inner surface 31 and a hollow cylindrical neck portion 36 extending transversely thereto. A first opening 37 in the head portion 35 is axially aligned with the outer end 17 of the inner conductor 13 while a second opening 38 in the neck portion 36 is transversely aligned with the outer end 17 of the inner conductor 13. An electrically conductive ring 39 is retained within the outer groove 33 and is engaged by a circular cap 40 that covers the first opening 37 and is soldered to the head portion 35 of the outer body 22.

Figure 1:
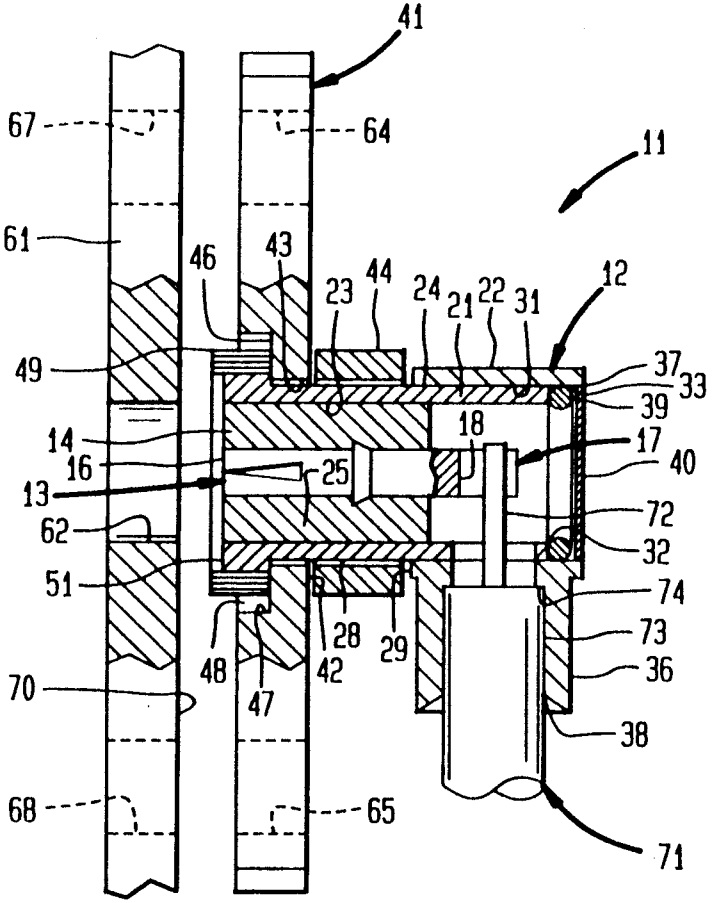
FIG. 1 is a partial cross sectional view of a coaxial connector according to the invention.
Figure 4:
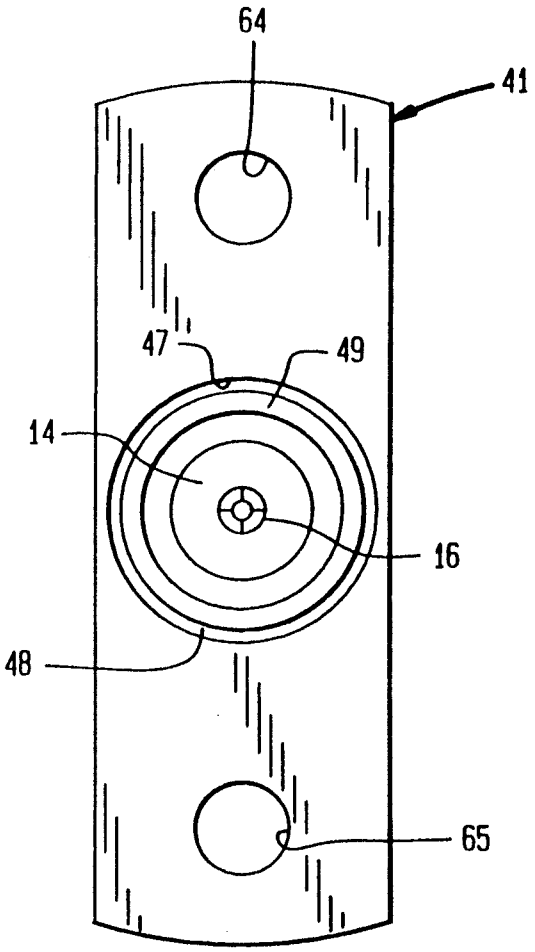
FIG. 4 is a right end view of the connector shown in FIGS. 1 and 2.
Figure 3:
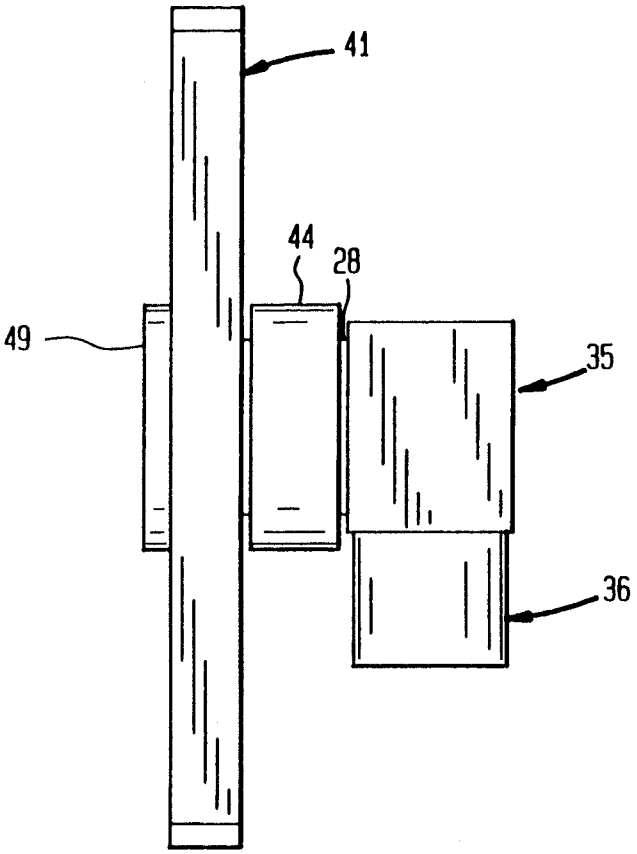
FIG. 3 is an elevational view of the connector shown in FIG. 1.

Also included in the connector 11 is an electrically conductive, rectangularly shaped mounting flange plate 41 projecting radially outwardly from the outer conductor 12. The mounting flange 41 has an inner portion 42 that is rotatably received by the annular recess 28 and defines a central aperture 43 that receives the cylindrical inner body 21. Also rotatably disposed in the annular recess 28 between the inner portion 42 of the mounting flange 41 and the inner edge 29 of the outer body 22 is an annular spacer 44. An annular transverse wall portion 46 of the inner portion 42 is intersected by an inner edge portion 47 of the mounting flange 41. Defined by the transverse wall portion 46, the inner edge portion 47 and the outer surface of the shoulder portion 25 is an annular inner groove 48 that retains an electrically conductive gasket 49, preferably formed from silver impregnated silicon. As shown in FIG. 1, an inner edge 51 of the inner body 21 forms a radially projecting, planar annular surface oriented substantially parallel to the mounting flange 44 and axially spaced therefrom.

During assembly of the connector 11, the mounting flange 41 first is passed over the outer end 32 of the cylindrical inner body 21 into engagement with the shoulder portion 25. The annular spacer 44 then is passed over the outer end 32 of the inner body 21 into the position illustrated in FIG. 1. Finally, the cylindrical inner surface 31 of the outer body 22 is pressed over the outer surface 24 of the inner body 21 to establish the relative positions also shown in FIG. 1. Finally, the outer body 22 is soldered to the inner body 21 so as to create the unitary outer conductor assembly 12.

During typical use, the connector 11 is connected to a mating coaxial connector (not shown) having an inner conductor that projects through an opening 62 in a housing 61 and engages the inner end socket 16 of the inner conductor 13. Next, the mounting flange 41 is rotated within the annular recess 28 until registration is obtained between fastener holes 64 and 65 in the flange 41 and holes 67, 68 in the housing 61. Insertion and tightening of bolts (not shown) through the openings 64, 65 and 67, 68 respectively, secures the connector 11 to the housing 61. During the securement process, the gasket 49 is compressed into the inner groove 48 as the inner edge 51 of the inner body 21 is forced into engagement with an outer surface 70 of the housing 61. Next, a coaxial cable 71 is inserted into the second opening 38 until an inner conductor 72 thereof projects into the transverse slot 18 of the inner conductor 13 and an outer conductor portion 73 seats against an internal annular shoulder 74 formed in the neck portion 36. After soldering of the inner conductor cable 72 within the transverse slot 18, the ring 52 is inserted into the outer groove 33 and the cap 53 is soldered to the outer body 22 to cover the first opening 37.

Obviously, many modifications and variations of the present invention are possible in light of the above teachings. It is to be understood, therefore, that the invention can be practiced otherwise than as specifically described.

What is claimed is:

1. A coaxial cable connector comprising:

an annular outer conductor means having an inner cylindrical surface and an outer cylindrical surface defining an annular recess;

an inner conductor disposed coaxially within said outer conductor means;

an annular insulator retained between said inner conductor and said outer conductor means and engaging said inner cylindrical surface; and an annular mounting the flange plate rotatably mounted on said outer conductor means and projecting radially outwardly therefrom, said annular mounting flange plate defining a plurality of fastener holes and having an inner portion rotatably received by said annular recess.

2. A connector according to claim 1 wherein said mounting flange plate is electrically conductive.

3. A connector according to claim 1 wherein said outer conductor means comprises a hollow cylindrical inner body with a radially outwardly projecting shoulder portion defining one sidewall of said annular recess, and an annular outer body with an inner cylindrical surface engaging said inner body and having an annular inner edge longitudinally spaced from said shoulder portion and defining another sidewall of said annular recess.

4. A connector according to claim 3 wherein said annular outer body is soldered to said inner body so as to create a unitary assembly.

5. A connector according to claim 1 including an annular spacer rotatably received by said annular recess and disposed between said inner portion of said mounting flange and said another sidewall.

6. A connector according to claim 1 wherein said inner portion of said mounting flange plate includes an annular transverse wall portion projecting transversely to said inner conductor; said mounting flange plate includes an annular inner edge portion intersecting said transverse wall portion, projecting longitudinally thereto, and spaced from said outer cylindrical surface; said annular transverse wall portion, said annular inner edge portion and said outer cylindrical surface forming an inner annular groove.

7. A connector according to claim 6 including an annular electrically conductive gasket disposed in said inner annular groove.

8. A connector according to claim 7 wherein said outer conductor means defines a radially extending inner edge portion oriented substantially parallel to said mounting flange plate and axially spaced therefrom.

9. A connector according to claim 8 wherein said outer conductor means comprises a hollow cylindrical inner body with a radially outwardly projecting shoulder portion defining one sidewall of said annular recess, and an annular outer body with an inner cylindrical surface engaging said inner body and having an annular inner edge longitudinally spaced from said shoulder portion and defining another sidewall of said annular recess.

10. A connector according to claim 9 wherein said annular outer body is soldered to said inner body so as to create a unitary assembly.

11. A connector according to claim 10 including an annular spacer rotatably received by said annular recess and disposed between said inner portion of said mounting flange plate and said another sidewall.

12. A connector according to claim 11 wherein said inner conductor has inner and outer ends, and said annular outer body defines a first opening axially aligned with said outer end and a second opening transversely aligned with said outer end.

13. A connector according to claim 12 including a cap covering said first opening.

14. A connector according to claim 14 wherein said cylindrical inner body has an outer edge, said annular outer body extends axially from said outer edge so as to form therewith an annular outer groove, and including an electrically conductive ring disposed in said outer groove and engaged by said cap.

15. A connector according to claim 4 wherein said inner conductor has inner and outer ends, and said annular outer body defines a first opening axially aligned with said outer end and a second opening transversely aligned with said outer end.

16. A connector according to claim 15 including a cap covering said first opening.

17. A connector according to claim 16 wherein said cylindrical inner body has an outer edge, said annular outer body extends axially from said outer edge so as to form therewith an annular outer groove, and including an electrically conductive ring disposed in said outer groove and engaged by said cap.

18. A connector according to claim 18 wherein said annular outer body is soldered to said inner body so as to create a unitary assembly.

19. A connector according to claim 18 wherein said inner portion of said mounting flange plate includes an annular transverse wall portion projecting transversely to said inner conductor; said mounting flange plate includes an annular inner edge portion intersecting said transverse wall portion, projecting longitudinally thereto, and spaced from said outer cylindrical surface; said annular transverse wall portion, said annular inner edge portion and said outer cylindrical surface forming an inner annular groove.

* * * * *